US010718323B2

(12) United States Patent
Bennett, Jr. et al.

(10) Patent No.: US 10,718,323 B2
(45) Date of Patent: Jul. 21, 2020

(54) SYNTHETIC JET PUMP AND AN ASSOCIATED METHOD THEREOF

(71) Applicant: NUOVO PIGNONE TECNOLOGIE Srl, Florence (IT)

(72) Inventors: Grover Andrew Bennett, Jr., Esperance, NY (US); Matthew Patrick Boespflug, Clifton Park, NY (US); Tak Kwong Woo, Salt Lake City, UT (US)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 428 days.

(21) Appl. No.: 15/606,073

(22) Filed: May 26, 2017

(65) Prior Publication Data

US 2018/0340529 A1 Nov. 29, 2018

(51) Int. Cl.
*F04B 43/04* (2006.01)
*B06B 1/06* (2006.01)
(Continued)

(52) U.S. Cl.
CPC ..... *F04B 43/046* (2013.01); *B06B 1/0603* (2013.01); *F04B 43/0054* (2013.01); *F04B 49/06* (2013.01)

(58) Field of Classification Search
CPC .... F04B 43/046; F04B 43/0054; F04B 49/06; F04B 43/025; F04B 45/043; F04B 45/047; B06B 1/0603
See application file for complete search history.

(56) References Cited

U.S. PATENT DOCUMENTS 4,115,036 A 9/1978 Paterson
5,192,197 A * 3/1993 Culp ..... F04B 35/04 417/322

(Continued)

FOREIGN PATENT DOCUMENTS

WO 9742412 A1 11/1997

OTHER PUBLICATIONS

Bar-Cohen et al., "Piezoelectrically Actuated Miniature Peristaltic Pump", SPIE's 7th Annual International Symposium on Smart Structures and Materials, vol. No. 4327, Mar. 2000, pp. 1-8.

(Continued)

*Primary Examiner* — Patrick Hamo
*Assistant Examiner* — Joseph S. Herrmann
(74) *Attorney, Agent, or Firm* — Baker Hughes Patent Organization

(57) ABSTRACT

A synthetic jet pump and a method of pumping fluid using such a synthetic jet pump are disclosed. The synthetic jet pump includes a plurality of first stacks disposed in a series arrangement relative to each other, and a plurality of first valves. A first stack of the plurality of first stacks includes a plurality of first connector pairs coupled to a first support structure and a plurality of first bimorph pairs. The first connector pairs and the first bimorph pairs are disposed in a parallel arrangement relative to each other respectively. A bimorph of one of the first bimorph pairs is coupled to a corresponding first connector pair. The plurality of first valves is disposed at an upstream end of the plurality of first stacks. A valve of the plurality of first valves is movably coupled to a corresponding connector of the plurality of the first connector pairs.

18 Claims, 8 Drawing Sheets

(51) Int. Cl.
*F04B 43/00* (2006.01)
*F04B 49/06* (2006.01)

(56) References Cited

U.S. PATENT DOCUMENTS

| | | | | |
|---|---|---|---|---|
| 5,267,841 | A * | 12/1993 | Culp | F02K 9/46 417/322 |
| 5,798,600 | A | 8/1998 | Sager et al. | |
| 6,074,178 | A | 6/2000 | Bishop et al. | |
| 6,722,581 | B2 | 4/2004 | Saddoughi | |
| 6,759,769 | B2 * | 7/2004 | Kirjavainen | H04R 7/02 307/400 |
| 7,967,258 | B2 * | 6/2011 | Smith | B64C 21/08 239/102.2 |
| 8,405,277 | B2 * | 3/2013 | Goyal | F03G 7/005 310/300 |
| 8,421,304 | B2 * | 4/2013 | Hino | H01L 41/047 310/300 |
| 8,820,658 | B2 * | 9/2014 | Saddoughi | H01L 41/0973 239/102.2 |
| 8,841,820 | B2 * | 9/2014 | Bennett | F04B 17/003 310/328 |
| 2002/0098098 | A1 | 7/2002 | Miesner | |
| 2015/0093257 | A1 | 4/2015 | Lastra | |

OTHER PUBLICATIONS

Bruno Dehez, "Improved Constitutive Equations of Piezoelectric Monomorphs:Application to the Preliminary Study of an Original Traveling wave Peristaltic pump" Sensors and Actuators A: Physical, vol. No. 169, Issue No. 01, Sep. 10, 2011, pp. 141-150.

* cited by examiner

SYNTHETIC JET PUMP AND AN ASSOCIATED METHOD THEREOF

BACKGROUND

The present disclosure relates to pumps, and more particularly to synthetic jet pumps and method for operating such synthetic jet pumps.

Positive-displacement pumps such as a rotary vane pump, a reciprocating pump or a diaphragm pump typically include a pump chamber, an inlet valve which opens the pump chamber to an inlet pipe during suction stroke, an outlet valve which opens the pump chamber to a discharge pipe during discharge stroke, and a drive mechanism. The pumping action is generated through alternating filling and clearing of the pump chamber, caused by motion generated due to a drive mechanism of the pump. Such pumps generally include one or more frictional parts such as pistons, vanes mounted on a rotor, and the like. Typically, such positive-displacement pumps are complex in nature due to: i) many interconnected components such as connecting rods and rotating cranks, which are coupled to the frictional parts, and ii) other components such as bearings, motors coupled to the interconnected components. Therefore, positive-displacement pumps may be relatively expensive to install and maintain. Further, such positive-displacement pumps may not be flexible in nature, thereby making such pumps difficult to install in many retrofit applications. Accordingly, there is a need for an enhanced pump which is substantially free of frictional components and is flexible enough to perform retrofit installation in many applications, and a method for operating such a pump.

BRIEF DESCRIPTION

In accordance with one aspect of the present description, a synthetic jet pump is disclosed. The synthetic jet pump includes a plurality of first stacks and a plurality of first valves. The plurality of first stacks is disposed in a series arrangement relative to each other. A first stack of the plurality of first stacks includes a plurality of first connector pairs and a plurality of first bimorph pairs. The plurality of first connector pairs is coupled to a first support structure. The first connector pairs are disposed in a parallel arrangement relative to each other and the first bimorph pairs are disposed in a parallel arrangement relative to each other. A bimorph of one of the first bimorph pairs is coupled to a corresponding first connector pair. The plurality of first valves is disposed at an upstream end of the plurality of first stacks. A valve of the plurality of first valves is movably coupled to a corresponding connector of the plurality of the first connector pairs.

In accordance with another aspect of the present description, a synthetic jet pump is disclosed. The synthetic jet pump includes a plurality of stacks and a plurality of valves. The plurality of stacks is arranged in an array. Each stack of the plurality of stacks includes a plurality of connector pairs and a plurality of bimorph pairs. The plurality of connector pairs is coupled to a support structure. The connector pairs are disposed in a parallel arrangement relative to each other. The plurality of bimorph pairs is disposed in a parallel arrangement relative to each other and each bimorph of the bimorph pair is coupled to a corresponding first connector pair. The plurality of valves is disposed at an upstream end of the plurality of stacks. Each valve of the plurality of valves is movably coupled to a corresponding connector of the plurality of connectors pairs.

In accordance with yet another aspect of the present description, a method for pumping fluid using a synthetic jet pump is disclosed. The method includes step (i) of actuating a plurality of first valves to allow intake of a fluid into a plurality of first stacks disposed in a series arrangement relative to each other. A first stack of the plurality of first stacks includes a plurality of first bimorph pairs and the first bimorph pairs are disposed in a parallel arrangement relative to each other. The method further includes the step (ii) of actuating a first bimorph pair of a first stack by applying a first voltage signal such that the first bimorph pair expands for receiving the fluid. Further, the method includes step (iii) of actuating a mutually adjacent first bimorph pair of a first stack that is serially arranged with respect to the first stack of the step (ii), by applying a second voltage signal such that the mutually adjacent first bimorph pair contracts for discharging the fluid. The second voltage signal is 180 degrees phase shifted from the first voltage signal.

DRAWINGS

These and other features and aspects of embodiments of the present technique will become better understood when the following detailed description is read with reference to the accompanying drawings in which like characters represent like parts throughout the drawings, wherein.

DETAILED DESCRIPTION

Figure 1:
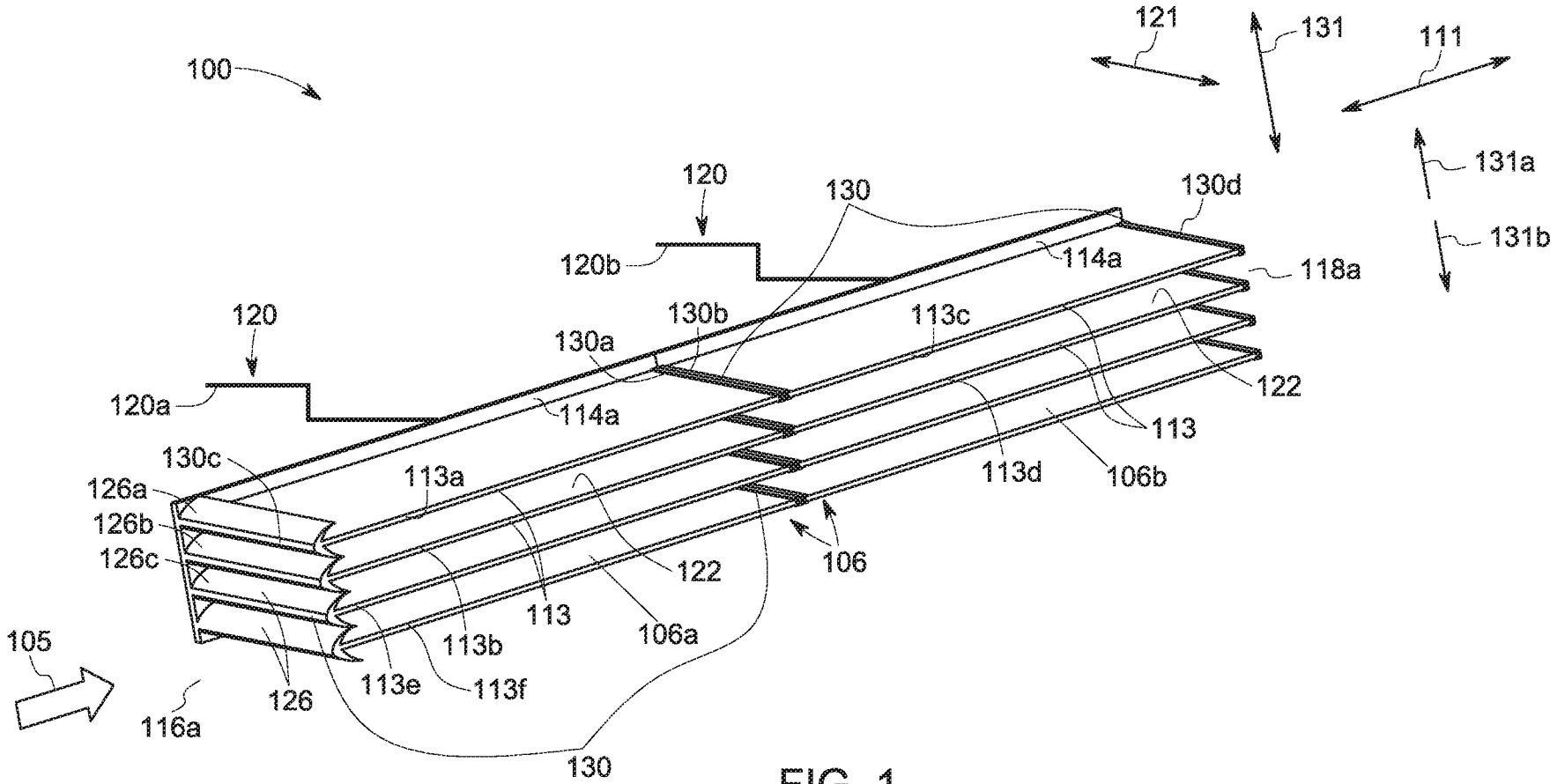
FIG. 1 is a perspective view of a portion of a synthetic jet pump including a plurality of first stacks, in accordance with one embodiment.

In the following specification and the claims, the singular forms "a", "an" and "the" include plural referents unless the context clearly dictates otherwise. As used herein, the term "or" is not meant to be exclusive and refers to at least one of the referenced components being present and includes instances in which a combination of the referenced components may be present, unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value.

Unless defined otherwise, technical and scientific terms used herein have the same meaning as is commonly understood by one of skill in the art to which this description belongs. The terms "comprising," "including," and "having" are intended to be inclusive, and mean that there may be additional elements other than the listed elements. The terms "first", "second", and the like, as used herein do not denote any order, quantity, or importance, but rather are used to distinguish one element from another. In the following specification and the claims that follow, the singular forms "a", "an" and "the" include plural referents unless the context clearly dictates otherwise.

To more clearly and concisely describe and point out the subject matter, the following definitions are provided for specific terms, which are used throughout the following description and the appended claims, unless specifically denoted otherwise with respect to a particular embodiment. The term "synthetic jet pump" as used herein refers to a pump made of piezoelectric materials, which may be actuated using electric power to pump a fluid from an upstream end to a downstream end. For example, the synthetic jet pump may include a plurality of bimorph pairs configured to expand and contract for receiving and discharging the fluid respectively. The term "bimorph" as used herein refers to a cantilever element which may be actuated using electric power to expand or contract for receiving and discharging the fluid respectively. The term "stack" as used herein refers to an arrangement of a plurality of bimorph pairs arranged in a radial direction with respect to the flow of fluid. The term "series arrangement" as used herein refers to sequential arrangement of the components along a direction of a flow of the fluid, for example, along the longitudinal direction. Therefore, a plurality of stacks that are sequentially arranged would refer to stacks that arranged along the direction of the fluid flow. The term "parallel arrangement" as herein refers to sequential arrangement of the components along the radial direction or a lateral direction of the synthetic jet pump. Therefore, a plurality of first stacks and second stacks that are parallelly arranged would refer to stacks that arranged along the radial direction or a lateral direction of the synthetic jet pump. The term "array" as used herein refers to an arrangement of stacks in rows and columns. For example, the term array as used herein refers to arrangement of the plurality of stacks along the lateral direction and the longitudinal direction. The term "movably coupled" as used herein refers to a valve coupled to the connector such that the valve may tilt upwards or downwards relative to the connector to either open or close the valve for allowing the flow of the fluid or stop the fluid respectively. The term "upstream end" as used herein refers to an inlet section of a component configured to receive a flow of fluid. For example, the term "an upstream end of a bimorph" refers to the inlet section of the bimorph for receiving the flow of the fluid. Similarly, the term "downstream end" as used herein refers to an outlet section of the component configured to discharge the fluid.

In some embodiments, a synthetic jet pump configured to pump fluid is presented. Non-limiting examples of the fluid that may be pumped using the synthetic jet pump in accordance with embodiments of the disclosure include multiphase hydrocarbon fluid, exhaust fluid, syngas, or combinations thereof.

The synthetic jet pump includes a plurality of first stacks and a plurality of first valves. Each stack within the plurality of first stacks is disposed in a series arrangement relative to each other. A stack of the plurality of first stacks includes a plurality of first connector pairs and a plurality of first bimorph pairs. The plurality of first connector pairs is coupled to a first support structure. The first connector pairs are disposed in a parallel arrangement relative to each other. The first bimorph pairs are disposed in a parallel arrangement relative to each other. A bimorph of one of the first bimorph pairs is coupled to a corresponding first connector pair. The plurality of valves is disposed at an upstream end of the plurality of first stacks. A valve of the plurality of first valves is movably coupled to a corresponding connector of the plurality of the first connector pairs.

FIG. 1 illustrates a perspective view of a portion of a synthetic jet pump 100 according to one embodiment of the description. In one example embodiment, the portion of the synthetic jet pump 100 includes a plurality of first stacks 106 and a plurality of first valves 126.

In one embodiment, the plurality of first stacks 106 includes a first stack 106*a* and a mutually adjacent first stack 106*b*, which are disposed in a series arrangement relative to each other. In the illustrated embodiment, the first stacks 106*a* and the mutually adjacent first stack 106*b* are disposed along a longitudinal direction 111 of the synthetic jet pump 100.

In one embodiment, the first bimorph pairs 113 are disposed in a parallel arrangement relative to each other. In the illustrated embodiment, each first bimorph pair of the plurality of first bimorph pairs 113 is disposed along the radial direction 131. In one example embodiment, the first bimorph pair 113 in the first stack 106*a* includes a first bimorph 113*a* and another first bimorph 113*b*. The first bimorphs 113*a*, 113*b* of the first bimorph pair 113 are disposed in the parallel arrangement relative to each other. For example, in the illustrated embodiment, the first stack 106*a* includes the plurality of first bimorphs 113*a*, 113*b*, 113*e*, 113*f* disposed in the parallel arrangement relative to one another, along the radial direction 131. Similarly, in one example embodiment, the first bimorph pair 113 in the mutually adjacent first stack 106*b* includes a first bimorph 113*c* and another first bimorph 113*d*. The first bimorphs 113*c*, 113*d* are disposed in the parallel arrangement relative to each other. In certain embodiments, a bimorph of the plurality of bimorph pairs includes a piezoelectric material. In some embodiments, the bimorph of the plurality of bimorph pairs may include an inactive layer and two active layers, each coupled to a mutually opposite surface of the inactive layer. In one embodiment, each of the two active layers may include a piezoceramic material, or polymeric material, or metal alloy, and the like. Further, each of the two active layers may have a mutually opposite polarity. During operation, each of the plurality of bimorph pairs 113 may produce a pressure difference over its ambient condition by moving the inactive layer in either upwards or downwards direction. In such an arrangement, each of the plurality of bimorph pairs 113 may sequentially expand and contract, thereby moving the fluid 105 through the bimorph pair 113 in the first stack 106*a* to a mutually adjacent bimorph pair 113 in the mutually adjacent first stack 106*b* disposed in a series arrangement relative to each other (as illustrated and described in detail later with respect to FIGS. 2, 4, and 5).

In some embodiments, the first stack 106*a* and the mutually adjacent first stack 106*b* include a plurality of first connector pairs 130 and a plurality of first bimorph pairs 113. The first connector pairs 130 are disposed in a parallel arrangement relative to each other. In the illustrated embodiment, each of the plurality of first connector pairs 130 is disposed along a radial direction 131 of the synthetic jet pump 100. The plurality of first connector pairs 130 is coupled to a first support structure 114*a*. In some embodiments, the plurality of first connector pairs 130 and the first support structure 114*a* are integrated to each other as a single component. In such embodiments, the plurality of first connector pairs 130 extends from one surface of the first support structure 114*a* along a lateral direction 121 of the synthetic jet pump 100. Further, one first connector, for example, a downstream first connector 130*a* disposed in the first stack 106*a* is further coupled to a mutually adjacent first connector, for example, an upstream first connector 130*b* disposed in the mutually adjacent first stack 106*b*. In some embodiment, the first support structure 114*a* and the plurality of first connector pairs 130 are made of steel material. In some other embodiments, the first support structure 114*a* and the plurality of first connector pairs 130 may be made of polymer material and the like.

In one embodiment, the first bimorph 113*a* of the first bimorph pair 113 is coupled to the corresponding first connector pair 130. Specifically, the first bimorph 113*a* is coupled to the upstream first connector 130*c* and the downstream first connector 130*a* of the first connector pair 130. Similarly, the first bimorph 113*c* is coupled to the upstream first connector 130*b* and a downstream first connector 130*d* of the first connector pair 130. In one embodiment, the first bimorphs 113*a*, 113*b* in the first stack 106*a* are in fluid communication with the first bimorphs 113*c*, 113*c* in the mutually adjacent and serially arranged first stack 106*b*. In one example embodiment, the first bimorphs 113*a*, 113*b* in the first stack 106*a* and the first bimorphs 113*c*, 113*d* in the mutually adjacent first stack 106*b* define a first flow path 122 such that the first stack 106*a* and the mutually adjacent first stack 106*h* are in fluid communication with each other.

The plurality of first valves 126 is disposed at an upstream end 116*a* of the plurality of first stacks 106. In the illustrated embodiment, the plurality of first valves 126 are disposed along the radial direction 131. In some embodiments, each of the plurality of first valves 126 is movably coupled to a corresponding upstream first connector of the first connector pair 130 in the first stack 106*a*. In one example embodiment, a first valve 126*a* of the plurality of first valves 126 is movably coupled to a corresponding upstream first connector 130*c* of the plurality of first connector pairs 130 in the first stack 106*a*.

The synthetic jet pump 100 further includes a plurality of power supply lines 120. In some embodiments, the plurality of power supply lines 120 is coupled to at least one power source (not shown). In the illustrated embodiment, the synthetic jet pump 100 includes two first power supply lines 120*a*, 120*b*. In some embodiments, each of the plurality of power supply lines 120 may be configured to supply electric power to the plurality of first bimorph pairs 113.

During operation, the plurality of first valves 126 are actuated to allow intake of fluid 105 into the first stack 106*a*. In the illustrated embodiment, the fluid 105 flows along the longitudinal direction 111. In one example embodiment, at least two first valves 126*a*, 126*b* are actuated to allow the intake of the fluid 105 into the first flow path 122. The first bimorph pair 113 in the first stack 106*a* is actuated by applying a first voltage signal such that the first bimorphs 113*a*, 113*b* expand for receiving the fluid 105. In some embodiments, the term "expand" as used in the context means moving the first bimorphs 113*a*, 113*b* along a first radial direction 131*a* and a second radial direction 131*b* respectively, to define a convex shape (as shown by first bimorphs 113*c*, 113*d* in FIG. 4) for the first flow path 122, and thereby allowing the first bimorph pair 113 to receive the fluid 105. In certain embodiments, the actuation of the first bimorphs 113*a*, 113*b* may also result in actuating the at least two first valves 126*a*, 126*b* simultaneously, to allow the intake of the fluid 105 into the first stack 106*a*. Further, the first bimorph pair 113 in the mutually adjacent first stack 106*b* is actuated by applying a second voltage signal such that the first bimorphs 113*c*, 113*d* in the mutually adjacent first stack 106*b* contract for discharging the fluid 105. In some embodiments, the term "contract" as used in the context means moving the first bimorphs 113*c*, 113*d* along the second radial direction 131*b* and the first radial direction 131*a* respectively, to define a concave shape as shown by first bimorphs 113*a*, 113*b* in FIG. 4) to the first flow path 122, and thereby allowing the first bimorph pair 113 to discharge the fluid 105. In certain embodiments, the first bimorphs 113*a*, 113*b* in the first stack 106*a* and the first bimorphs 113*c*, 113*c* in the mutually adjacent first stack 106*b* are actuated simultaneously to pump the fluid 105 from the upstream end 116*a* to a downstream end 118*a* of the plurality of first bimorph pairs 113.

After the intake of fluid 105 in the first bimorph pair 113 in the first stack 106*a*, the first bimorph pair 113 is further actuated by applying the second voltage signal such that the first bimorphs 113*a*, 113*b* contracts for discharging the fluid 105. In such embodiments, the actuation of first bimorph pair 113 in the first stack 106*a* may simultaneously actuate the first valves 126*a*, 126*b* to i) stop the intake of the fluid 105 into the first flow path 122 in the first stack 106*a* and ii) prevent the back flow of the fluid 105 from the first flow path 122 to the upstream end 116*a*. Further, the first bimorph pair 113 in the mutually adjacent first stack 106*b* may be actuated by applying the first voltage signal such that the first bimorphs 113*c*, 113*d* of the first bimorph pair 113 expand for receiving the fluid 105 from the first bimorph pair 113 in the first stack 106*a*.

Figure 2:
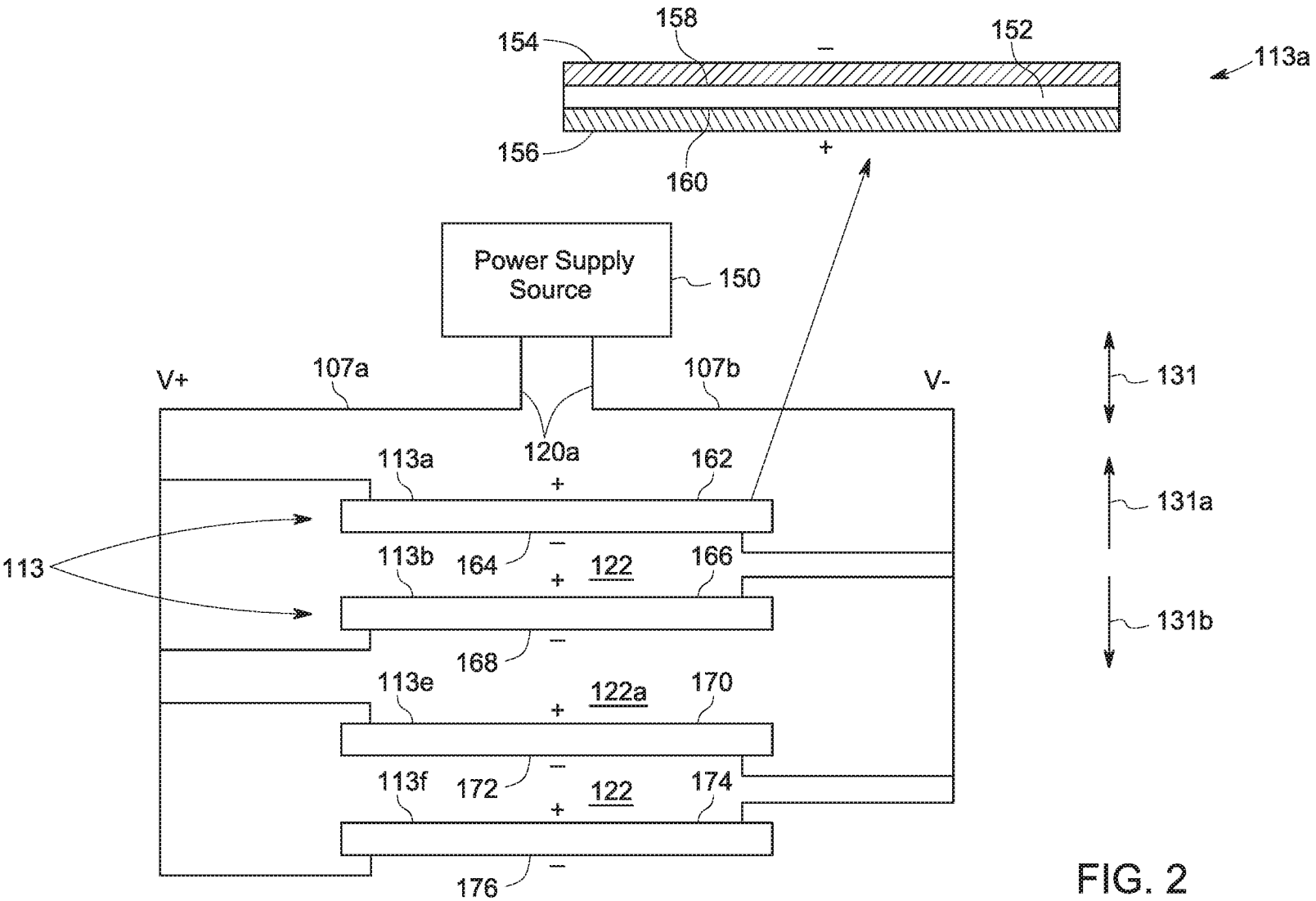
FIG. 2 is a block diagram of a plurality of first bimorph pairs in a first stack of the plurality of first stacks, in accordance with the embodiment of FIG. 1.

FIG. 2 is a block diagram of a plurality of first bimorph pairs 113 in the first stack 106*a* of the plurality of first stacks 106 according to the embodiment of FIG. 1. It should be noted herein that FIG. 2 represents the first stack 106*a* viewed from the upstream end 116*a* of the plurality of first stack 106 i.e., viewed from a direction of a flow of the fluid 105.

In the illustrated embodiment, the first stack 106*a* includes two first bimorph pairs 113, which are disposed in a parallel arrangement relative to each other. In the illustrated embodiment, each bimorph of the two first bimorph pairs 113 are disposed along a radial direction 131. The first bimorph pair 113 includes a first bimorph 113*a* and another first bimorph 113*b*. Similarly, another first bimorph pair 113 includes a first bimorph 113*e* and another first bimorph 113*f*. The first bimorphs 113*a*, 113*b* define a first flow path 122 there between, and the first bimorphs 113*e*, 113*f* also define another first flow path 122 there between. In certain embodiments, the two first bimorphs 113*b*, 113*e* of the of mutually adjacent first bimorph pairs 113 further define a first sub-fluid path 122*a*. In one embodiment, the first bimorphs 113*a*, 113*b*, 113*e*, 113*f* of the plurality of first bimorph pairs 113 includes a piezoelectric material. In some embodiments, the first bimorphs 113*a*, 113*b*, 113*e*, 113*f* of the first bimorph pairs 113 includes a central inactive layer and two active layers. The term "active layer" as used herein refers to a surface of the bimorph 113 that is sensitive and responsive to polarity of applied voltage. The term "passive layer" as used herein refers to a surface of the bimorph 113 that is insensitive and non-responsive to the polarity of applied voltage, and which functions as a support structure for the active layers. In such embodiments, the two active layers are coupled to mutually opposite surfaces of the central inactive layer. For example, in the illustrated embodiment, the first bimorph 113*a* includes a central inactive layer 152 such as a shim, and two active layers 154, 156 such as piezoceramic layers. In one embodiments, the two active layers 154, 156 are coupled to mutually opposite surfaces 158, 160 of the central inactive layer 152 respectively.

In one example embodiment, the synthetic jet pump 100 further includes a power supply source 150 and a first power supply line 120*a* extending from the power supply source 150 and coupled to the first bimorphs 113*a*, 113*b*, 113*e*, 113*f*. In some embodiments, the power supply source 150 is an alternating current supply source. In some other embodiments, the power supply source 150 may be a direct current supply source. In the illustrated embodiment, the first power supply line 120*a* includes a first voltage signal line 107*a* and a second voltage signal line 107*b*. The first voltage signal line 107*a* is coupled to top surfaces 162, 170 of the first bimorphs 113*a*, 113*e* and to the bottom surfaces 168, 176 of the first bimorphs 113*b*, 113*f* respectively. Similarly, the second voltage signal line 107*b* is coupled to top surfaces 166, 174 of the first bimorphs 113*b*, 113*f* and to the bottom surfaces 164, 172 of the first bimorphs 113*a*, 113*e* respectively. In some embodiments, the first voltage signal line 107*a* has a positive polarity and the second voltage signal line 107*b* has a negative polarity. In other words, the first voltage signal line 107*a* is 180 degrees phase shifted from the second voltage signal line 107*b*. In one embodiment, mutually opposite surfaces 162, 168 of the first bimorph pair 113 have a first polarity and mutually adjacent surfaces 164, 166 of the first bimorph pair 113 have a second polarity different from the first polarity. For example, in the illustrated embodiment, the mutually opposite surfaces 162, 168 have a positive polarity and the mutually adjacent surfaces 164, 166 have a negative polarity.

During operation, the first bimorphs 113*a*, 113*b*, 113*e*, 113*f* are actuated by applying a first voltage signal via the first voltage signal line 107*a*. The actuation of the first bimorph pairs 113 causes the first bimorphs 113*a*, 113*e* to move along a first radial direction 131*a* and the first bimorphs 113*b*, 113*f* to move along a second radial direction 131*b*, thereby causing the first flow path 122 to expand for receiving the fluid. In certain embodiments, the actuation of the first bimorphs 113*b*, 113*e* causes the first sub-fluid path 122*a* to contract, thereby discharge the fluid from the first sub-fluid path 122*a*. After the intake of fluid in the first flow path 122, the first bimorphs 113*a*, 113*b*, 113*e*, 113*f* are further actuated by applying a second voltage signal via the second voltage signal line 107*b*. The actuation of the first bimorph pairs 113 causes the first bimorphs 113*a*, 113*e* to move along the second radial direction 131*b* and the first bimorphs 113*b*, 113*f* to move along the first radial direction 131*a*, thereby causing the first flow path 122 to contract for discharging the fluid. In certain embodiments, the actuation of the first bimorphs 113*b*, 113*e* causes the first sub-fluid path 122*a* to expand, thereby receiving the fluid.

Figure 3:
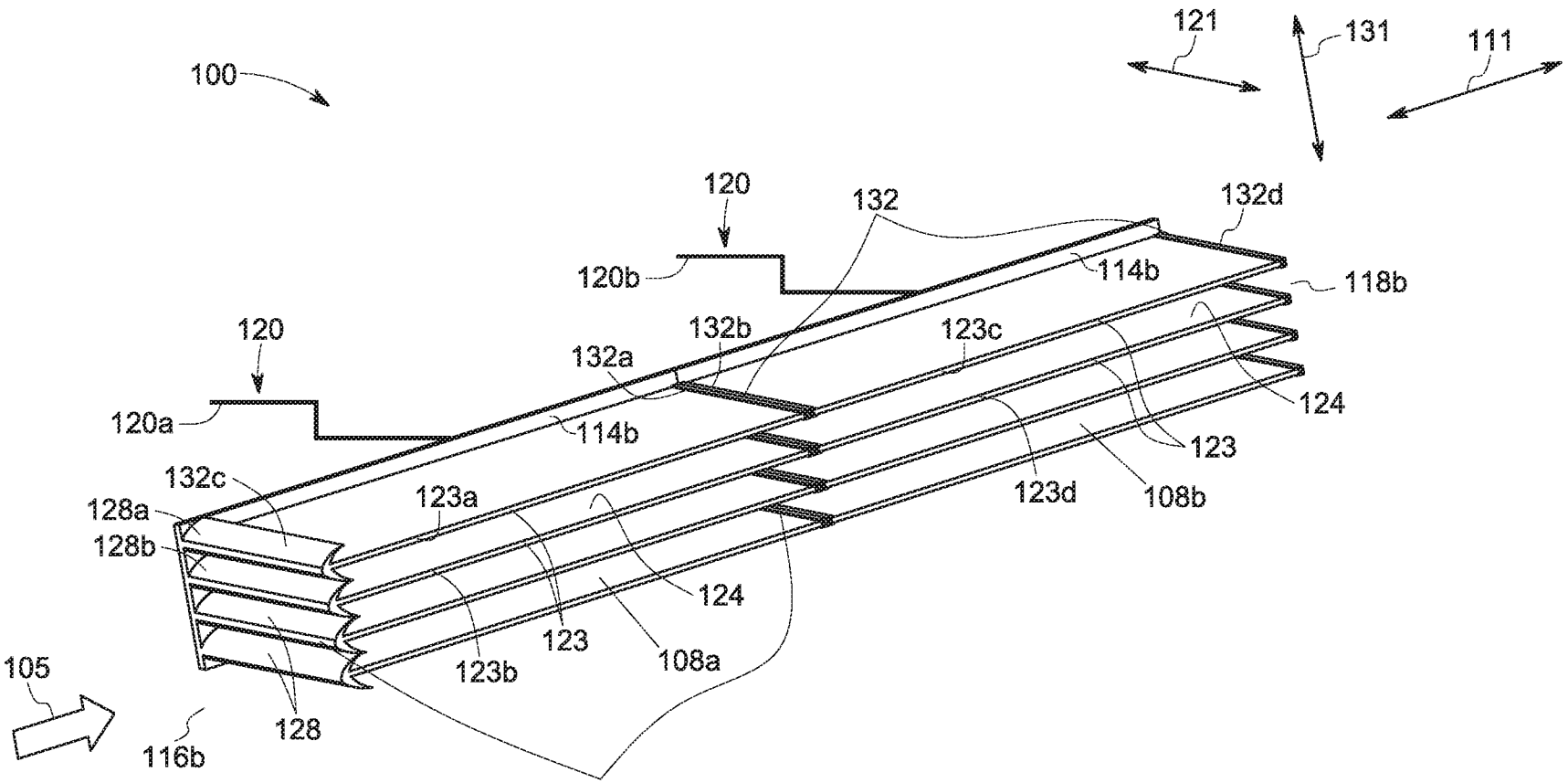
FIG. 3 is a perspective view of another portion of the synthetic jet pump including a plurality of second stacks, in accordance with the embodiments of FIGS. 1-2.

FIG. 3 illustrates a perspective view of another portion of the synthetic jet pump 100 according to the embodiments of FIGS. 1-2. In one example embodiment, the other portion of the synthetic jet pump 100 includes a plurality of second stacks 108 and a plurality of second valves 128.

The plurality of second stacks 108 includes a second stack 108*a* and a mutually adjacent second stack 108*b*, which are disposed in a series arrangement relative to each other. In some embodiments, the second stack 108*a* and the mutually adjacent second stack 108*b* include a plurality of second connector pairs 132 and a plurality of second bimorph pairs 123. The plurality of second connector pairs 132 is coupled to a second support structure 114*b*. In one example embodiment, the second bimorph pair 123 in the second stack 108*a* includes a second bimorph 123*a* and another second bimorph 123*b*. Similarly, in one example embodiment, the second bimorph pair 123 in the mutually adjacent second stack 108*h* includes a second bimorph 123*c* and another second bimorph 123*d*. The second bimorph 123*a* is coupled to the upstream second connector 132*c* and the downstream second connector 132*a* of the second connector pair 132. Similarly, the second bimorph 123*c* is coupled to the upstream second connector 132*b* and a downstream second connector 132*d* of the second connector pair 132. In one example embodiment, the second bimorphs 123*a*, 123*b* in the second stack 108*a* and the second bimorphs 123*c*, 123*d* in the mutually adjacent second stack 108*b* define a second flow path 124 such that the second stack 108*a* and the mutually adjacent second stack 108*b* are in fluid communication with each other.

The plurality of second valves 128 is disposed at an upstream end 116*b* of the plurality of second stacks 108. In some embodiments, each of the plurality of second valves 128 is movably coupled to a corresponding upstream second connector of the second connector pair 132 in the second stack 108*a*. In one example embodiment, a second valve 128*a* of the plurality of second valves 128 is movably coupled to a corresponding upstream second connector 132*c* of the plurality of the second connector pairs 132 in the second stack 108*a*. The synthetic jet pump 100 further includes the plurality of power supply lines 120. In the illustrated embodiment, the synthetic jet pump 100 includes two first power supply lines 120*a*, 120*b*. In one embodiment, each of the plurality of power supply lines 120 is configured to supply electric power to the plurality of second bimorph pairs 123.

The plurality of second bimorph pairs 123 is substantially similar to the plurality of first bimorph pairs 113 of the embodiment of FIG. 2. Although not illustrated, the second bimorphs 123*a*, 123*b* have the same polarity as that of the first bimorphs 113*a*, 113*b* as discussed in the embodiment of FIG. 2. In other words, mutually opposite surfaces of the second bimorphs 123*a*, 123*b* of the second bimorph pair 123 have a first polarity and mutually adjacent surfaces of the second bimorphs 123*a*, 123*b* of the second bimorph pair 123 have a second polarity different from the first polarity. For example, the mutually opposite surfaces of the second bimorphs 123*a*, 123*b* have a positive polarity, which is similar to the polarity of the mutually opposite surfaces 162, 168 of the first bimorphs 113*a*, 113*b*, as discussed in the embodiment of FIG. 2. Further, the mutually adjacent surfaces of the second bimorphs 123*a*, 123*b* have a negative polarity, which is similar to the polarity of the mutually adjacent surfaces 164, 166 of the first bimorphs 113*a*, 113*b*, as discussed in the embodiment of FIG. 2.

Figure 4:
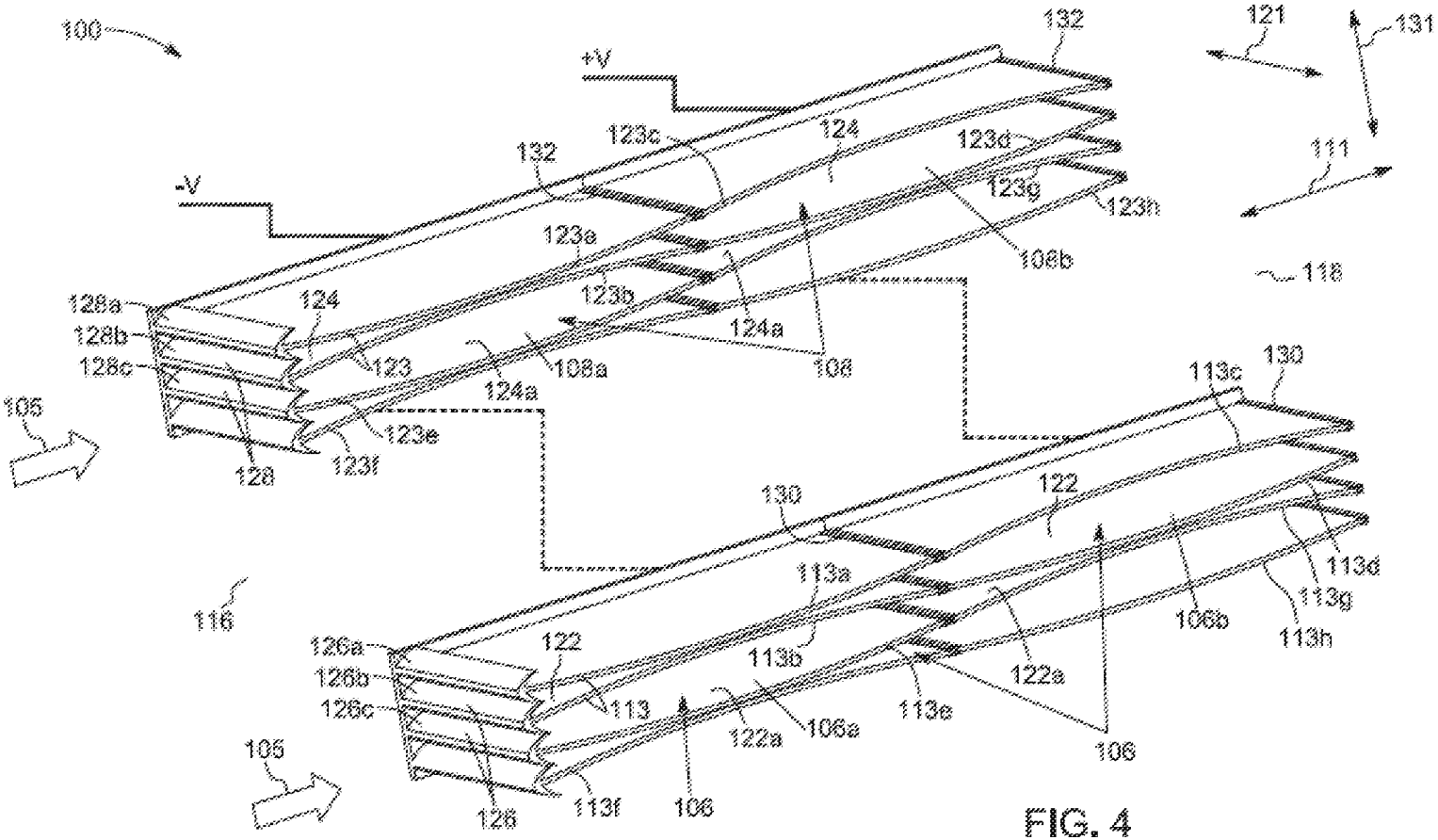
FIG. 4 is an exploded perspective view of an operating stage of the synthetic jet pump, in accordance with the embodiments of FIGS. 1-3.
Figure 5:
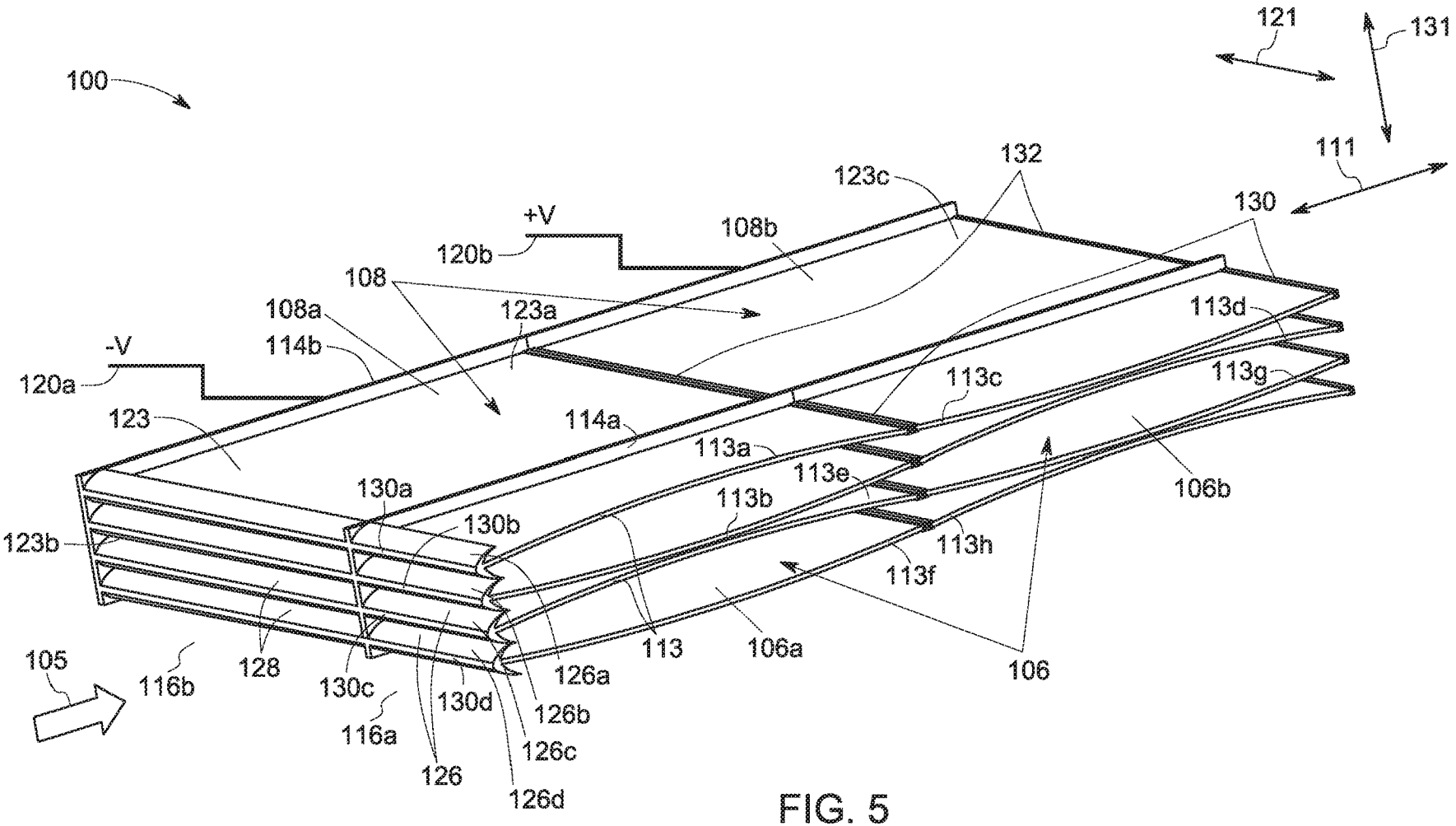
FIG. 5 is a perspective view of an operating stage of a synthetic jet pump, in accordance with one embodiment.

In some embodiments, the plurality of first stacks 106 and the plurality of second stacks 108 are configured to pump the fluid 105 simultaneously, as shown in the embodiment of FIG. 4. In some other embodiments, the plurality of first stacks 106 and the plurality of second stacks 108 are configured to pump the fluid 105 sequentially, as shown in the embodiment of FIG. 5.

FIG. 4 illustrates an exploded perspective view of an operating stage of the synthetic jet pump 100 including the plurality of first stacks 106 and the plurality of second stacks 108, according to the embodiments of FIGS. 1-3. The plurality of second stacks 108 is disposed adjacent to the plurality of first stacks 106 in a parallel arrangement relative to the plurality of first stacks 106. In other words, the plurality of first stacks 106 and the plurality of second stacks 108 are disposed parallel to each other with respect to a flow of the fluid 105. Although not illustrated, the first support structure 114*a* is coupled to the second support structure 114*b* via the plurality of second connector pairs 132 to form the synthetic jet pump 100. Specifically, other free ends of the plurality of second connector pairs 132, which are not connected to the second support structure 114*b* may be further coupled to another surface of the first support structure 114*a*.

In the illustrated embodiment, the array has of 2×2 arrangement of the plurality of first stacks 106 and the plurality of second stacks 108. However, as described in detail later, other configurations of the array are also envisaged within the scope of the present description.

During operation, the synthetic jet pump 100 is configured to pump fluid 105 from the upstream end 116 to the downstream end 118. It should be noted herein that method for the operating the synthetic jet pump 100 is discussed herein using the first bimorphs 113*a*, 113*b*, 113*c*, 113*d* of the first bimorph pairs 113 and the second bimorphs 123*a*, 123*b*, 123*c*, 123*d* of the second bimorph pairs 123 for ease of describing the method and such a description should not be construed as a limitation of the disclosed technique. The first bimorphs 113*a*, 113*b* of the first bimorph pair 113 in the first stack 106*a* and the second bimorphs 123*a*, 123*b* of the second bimorph pair 123 in the second stack 108*a* are actuated by applying the second voltage signal such that the first bimorphs 113*a*, 113*b* and the second bimorph 123*a*, 123*b* contract to discharge the fluid 105 from the first flow path 122 and the second flow path 124 respectively. In such embodiments, the first valves 126*a*, 126*b* and the second valves 128*a*, 128*b* are actuated to stop intake of the fluid 105 into the first flow path 122 and the second flow path 124 respectively. The first bimorphs 113*c*, 113*d* of the first bimorph pair 113 in the mutually adjacent first stack 106*b* and the second bimorphs 123*c*, 123*d* of the second bimorph pair 123 in the mutually adjacent second stack 108*b* are actuated by applying the first voltage signal such that the first bimorph 113*c*, 113*d* and the second bimorphs 123*c*, 123*d* expand to receive the fluid 105 along the first flow path 122 and the second flow path 124 respectively. Specifically, the mutually adjacent first stack 106*b* and the mutually adjacent second stack 108*b* receives the fluid 105 from the first stack 106*a* and the second stack 108*a* respectively.

As mentioned earlier, in some embodiments, the synthetic jet pump 100 further includes a first sub-fluid path 122*a*, which is formed by the first bimorphs 113*b*, 113*e* of the first bimorph pair 113 and the first bimorphs 113*d*, 113*g* of a mutually adjacent first bimorph pair 113. Similarly, the synthetic jet pump 100 further includes a second sub-fluid path 124*a*, which is formed by the second bimorphs 123*b*, 123*e* of the second bimorph pair 123 and the second bimorphs 123*d*, 123*g* of a mutually adjacent second bimorph pairs 123. In such embodiments, the actuation of the first valves 126*b*, 126*c* and the second valves 128*b*, 128*c* allows intake of the fluid 105 into the first sub-fluid path 122*a* in the first stack 106*a* and the second sub-fluid path 124*a* in the second stack 108*a*. The actuation of the first bimorphs 113*b*, 113*e* by applying the second voltage signal may result in expanding the first bimorphs 113*b*, 113*e* to receive the fluid 105 in the first sub-fluid path 122*a* in the first stack 106*a*. Similarly, the actuation of the second bimorphs 123*b*, 123*e* by applying the second voltage signal may result in expanding the second bimorphs 123*b*, 123*e* to receive the fluid 105 in the second sub-fluid path 124*a* in the second stack 108*a*. Further, the actuation of the first bimorphs 113*d*, 113*g* by applying the first voltage signal may result in contracting the first bimorphs 113*d*, 113*g* to discharge the fluid 105 from the first sub-fluid path 122*a* in the mutually adjacent first stack 106*b*. Similarly, the actuation of the second bimorphs 123*d*, 123*g* by applying the first voltage signal may result in contracting the second bimorphs 123*d*, 123*g* to discharge the fluid 105 from the second sub-fluid path 124*a* in the mutually adjacent second stack 108*b*.

In the illustrated embodiments, the plurality of first stacks 106 and the plurality of second stacks 108 are configured to pump the fluid 105 simultaneously, thereby increasing the flow rate of the fluid 105 being pumped from the synthetic jet pump 100.

FIG. 5 illustrates perspective view of an operating stage of the synthetic jet pump 100, according to one embodiment of the description. In the illustrated embodiment, the plurality of first stacks 106 and the plurality of second stacks 108 of the synthetic jet pump 100 are configured to pump the fluid 105 sequentially.

In the illustrated embodiment, mutually opposite surfaces of the first bimorph 113*a*, 113*b* has a first polarity, such as a positive polarity, and mutually adjacent surfaces of the first bimorph 113*a*, 113*b* has a second polarity, such as a negative polarity. Similarly, mutually opposite surfaces of the first bimorph 113*c*, 113*d* has the second polarity, such as the negative polarity, and mutually adjacent surfaces of the first bimorph 113*g*, 113*h* has the first polarity, such as the positive polarity. Further, in the illustrated embodiment, mutually opposite surfaces of the second bimorph 123*a*, 123*b* has a second polarity, such as a negative polarity, and mutually adjacent surfaces of the second bimorph 123*a*, 123*b* has a first polarity, such as a positive polarity. Similarly, mutually opposite surfaces of the second bimorph 123*c*, 123*d* (similar to the second bimorph 123*d* as shown in FIG. 4) has the first polarity, such as the positive polarity, and mutually adjacent surfaces of the second bimorph 123*g*, 123*h* (similar to the second bimorph 123*g*, 123*h* as shown in FIG. 4) has the second polarity, such as the negative polarity.

During operation, the first bimorph 113*a*, 113*b* is actuated by applying the first voltage signal, thereby expanding the first bimorph 113*a*, 113*b* in the radial direction 131 for receiving fluid 105. Further, the first bimorph 113*c*, 113*d* is actuated by applying the second voltage signal, thereby contracting the first bimorph 113*c*, 113*d* in the radial direction 131 for discharging the fluid 105. Thus, at one time interval during operation of the synthetic jet pump, the plurality of first stacks is configured to discharge the fluid 105. Similarly, the second bimorph 123*a*, 123*b* is actuated by applying the second voltage signal, thereby contracting the second bimorph 123*a*, 123*b* in the radial direction 131 for discharging the fluid 105. Further, the second bimorph 123*c*, 123*d* is actuated by applying the first voltage signal, thereby expanding the second bimorph 123*c*, 123*d* in the radial direction 131 for receiving the fluid 105. Thus, at the same time interval during operation of the synthetic jet pump, the plurality of first stacks is configured to receive the fluid 105. Therefore, in such embodiments, the plurality of first stacks 106 and the plurality of second stacks 108 are configured to pump the fluid 105 sequentially.

In some embodiments, the synthetic jet pump includes a plurality of stacks arranged in an array and a plurality of valves disposed at an upstream end of the plurality of stacks. In one embodiment, each stack of the plurality of stacks includes a plurality of connector pairs and a plurality of bimorph pairs. The plurality of connector pairs is coupled to a support structure, wherein the connector pairs are disposed in a parallel arrangement relative to each other. The plurality of bimorph pairs is disposed in a parallel arrangement relative to each other, and wherein each bimorph of the bimorph pair is coupled to a corresponding first connector pair. Further, each valve of the plurality of valves is movably coupled to a corresponding connector of the plurality of connectors pairs.

Figure 6:
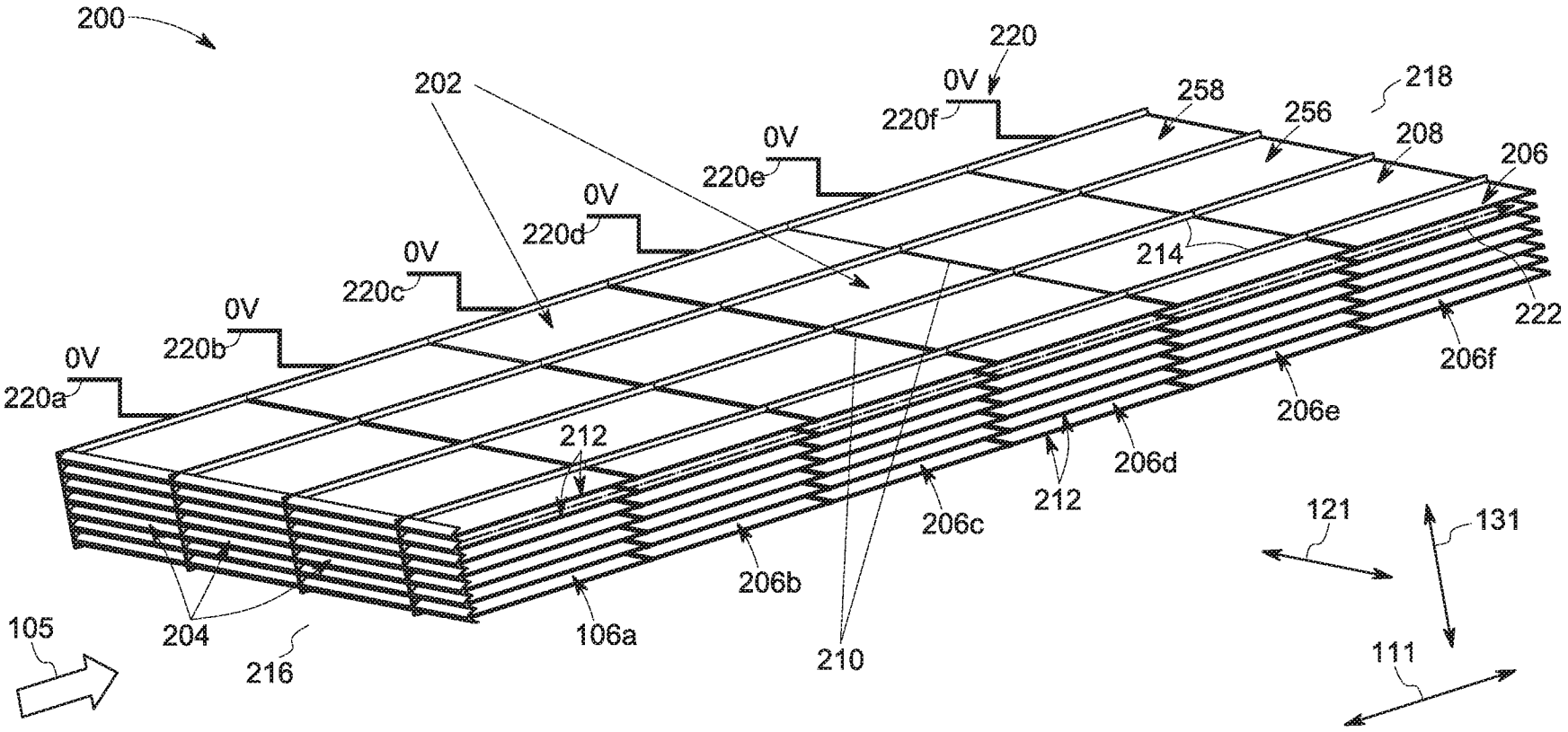
FIG. 6 is a perspective view of a synthetic jet pump, in accordance with another embodiment.

FIG. 6 illustrates a perspective view of a synthetic jet pump 200 according to another embodiment of the description. In one embodiment, the synthetic jet pump 200 includes a plurality of stacks 202 and a plurality of valves 204. The synthetic jet pump 200 is configured to pump fluid 105 from an upstream end 216 to a downstream end 218 of the synthetic jet pump 200 via the plurality of stacks 202.

In the illustrated embodiment, the plurality of stacks 202 includes a plurality of first stacks 206, a plurality of second stacks 208, a plurality of third stacks 256, and a plurality of fourth stacks 258. Each stack of the plurality of first, second, third, and fourth stacks 206, 208, 256, 258 is disposed in a series arrangement relative to each other. In the illustrated embodiment, each stack of the plurality of first, second, third, and fourth stacks 206, 208, 256, 258 is disposed along a longitudinal direction 111 of the synthetic jet pump 200. Specifically, the synthetic jet pump 200 includes six first stacks 206, which are disposed in the series arrangement relative to each other, six second stacks 208, which are disposed in the series arrangement relative to each other, six third stacks 256, which are disposed in the series arrangement relative to each other, and six fourth stacks 258, which are disposed in the series arrangement relative to each other. Further, the plurality of first, second, third, and fourth stacks 206, 208, 256, 258 are disposed parallel to each other relative to a flow of the fluid 105 and along a lateral direction 121 of the synthetic jet pump 200.

In the embodiment illustrated in FIG. 6, the plurality of first, second, third, and fourth stacks 206, 208, 256, 258 are arranged in the array. For example, in the illustrated embodiment, the array has a 4×6 arrangement of the plurality of stacks 202. Non-limiting example of the array may include 2×2, 2×4, 4×4, 3×6, and the like, based on desirable amount of the fluid 105 to be pumped from the synthetic jet pump 200 and flow rate at which the fluid 105 needs to be pumped by the synthetic jet pump 200. In some embodiments, the array has an n×m arrangement of the plurality of stacks 202, wherein n is from 2 to 100 and in is from 2 to 100.

Each stack of the plurality of stacks 202 includes a plurality of connector pairs 210 and a plurality of bimorph pairs 212. The plurality of connector pairs 210 is disposed in a parallel arrangement relative to each other. In the illustrated embodiment, the plurality of connector pairs 210 is disposed along a radial direction 131 of the synthetic jet pump 200. Each of the plurality of connector pairs 210 is coupled to a support structure 214.

In some embodiments, the plurality of bimorph pairs 212 is disposed in a parallel arrangement relative to each other. In the illustrated embodiment, the plurality of bimorph pairs 212 is disposed along a radial direction 131 of the synthetic jet pump 200. In the illustrated embodiment, each stack of the plurality of stacks 202 includes eight connector pairs 210 and four bimorph pairs 212. In such an embodiment, each bimorph of the bimorph pair 212 is coupled to at least one connector pair 210. In one embodiment, each bimorph of the plurality of bimorph pairs 212 includes a piezoelectric material.

In one embodiment, each bimorph pair 212 in each stack of the plurality of first, second, third, and fourth stacks 206, 208, 256, 258 defines a flow path between them. In some embodiments, the plurality of first, second, third, and fourth stacks 206, 208, 256, 258 are not in fluid communication with each other. For example, the plurality of first stacks 206 is fluidly separated from the plurality of second stacks 208 via the support structure 214. In some embodiments, the stacks in the plurality of first, second, third, and fourth stacks 206, 208, 256, 258 are in fluid communication with each other. For example, the first stacks in the plurality of first stacks 206 are in fluid communication with each other. Similarly, the second stacks in the plurality of second stacks 208 are in fluid communication with each other.

The plurality of valves 204 is disposed at the upstream end 216 of the synthetic jet pump 200. Each of the plurality of valves 204 is movably coupled to a corresponding connector of the plurality of connectors pairs 210 in the first stack of the plurality of first, second, third, and fourth stacks 206, 208, 256, 258. In some embodiments, each of the plurality of valves 204 may be configured to function like a hinge. In such embodiments, each of the of the plurality of valves 204 may tilt upwards or downwards relative to the connector of the connector pair 210 to open or close the corresponding valve 204. Specifically, at least some valves of the plurality of valves 204 are configured to open thereby allowing intake of the fluid 105 into some of the plurality of stacks 202, or at least some valves of the plurality of valves 204 are configured to close thereby stopping the intake of the fluid 105 into some of the plurality of stacks 202. In one embodiment, each valve of the plurality of valves 204 is a check valve. In some embodiments, each valve of the plurality of valves 204 is made of polymer material. In some other embodiments, each valve of the plurality of valves 204 is made of steel material, and the like.

The synthetic jet pump 200 further includes a plurality of power supply lines 220. In some embodiments, the plurality of power supply lines 220 is coupled to at least one power source (not shown). In the illustrated embodiment, the synthetic jet pump 200 includes six power supply lines 220*a*, 220*b*, 220*c*, 220*d*, 220*e*, 220*f*. In some embodiments, the plurality of power supply lines 220 may be configured to supply electric power to the plurality of bimorph pairs 212.

It should be noted herein that the method of operating the synthetic jet pump 200 is discussed herein by referring to the plurality of first stacks 206, for ease of description only. During operation, each of the plurality of valves 204 corresponding to the plurality of first stack 206 is actuated to open for allowing intake of the fluid 105 into the plurality of first stacks 206. In some embodiments, the bimorph pair 212 in a first stack 206*a* of the plurality of first stacks 206 is actuated by applying a first voltage signal such that the bimorph pair 212 expands for receiving the fluid 105 along a first flow path 222. In certain embodiments, the first voltage signal is applied via the power supply line 220*a*. Further, the bimorph pair 212 in mutually adjacent first stack 206*b* is actuated by applying a second voltage signal such that the bimorph pair 212 contracts for discharging the fluid 105 from the first flow path 222. In certain embodiments, the second voltage signal is applied via the power supply line 220*b*. Further, the bimorph pair 212 in a mutually adjacent first stack 206*c* of the plurality of first stacks 206 is actuated by applying the first voltage signal such that the bimorph pair 212 expands for receiving the fluid 105 along the first flow path 222. In certain embodiments, the first voltage signal is applied via the power supply line 220*c*. Further, the bimorph pair 212 in a mutually adjacent first stack 206*d* is actuated by applying the second voltage signal such that the bimorph pair 212 contracts for discharging the fluid 105 from the first flow path 222. In certain embodiments, the second voltage signal is applied via the power supply line 220*d*. Further, the bimorph pair 212 in a mutually adjacent first stack 206*e* of the plurality of first stacks 206 is actuated by applying the first voltage signal such that the bimorph pair 212 expands for receiving the fluid 105 along the first flow path 222. In certain embodiments, the first voltage signal is applied via the power supply line 220*e*. Further, the bimorph pair 212 in a mutually adjacent first stack 206*f* is actuated by applying the second voltage signal such that the bimorph pair 212 contracts for discharging the fluid 105 from the first flow path 222. In certain embodiments, the second voltage signal is applied via the power supply line 220*f*.

In some embodiment, the plurality of stacks 202 is configured to simultaneously pump the fluid 105 from the upstream end 216 to the downstream end 218. Similarly, the first, second, third, and fourth stacks 206, 208, 256, 258 may be operated to pump the fluid 105 from the upstream end 216 to the downstream end 218. In some embodiments, the bimorph pairs 212 in the plurality of first, second, third, and fourth stacks 206, 208, 256, 258 are configured to pump the fluid 105 simultaneously as discussed in the embodiments of FIGS. 1-4. In some other embodiments, the bimorph pairs 212 in the plurality of first, second, third, and fourth stacks 206, 208, 256, 258 may be configured to pump the fluid 105 sequentially as discussed in the embodiment of FIG. 5.

Figure 7:
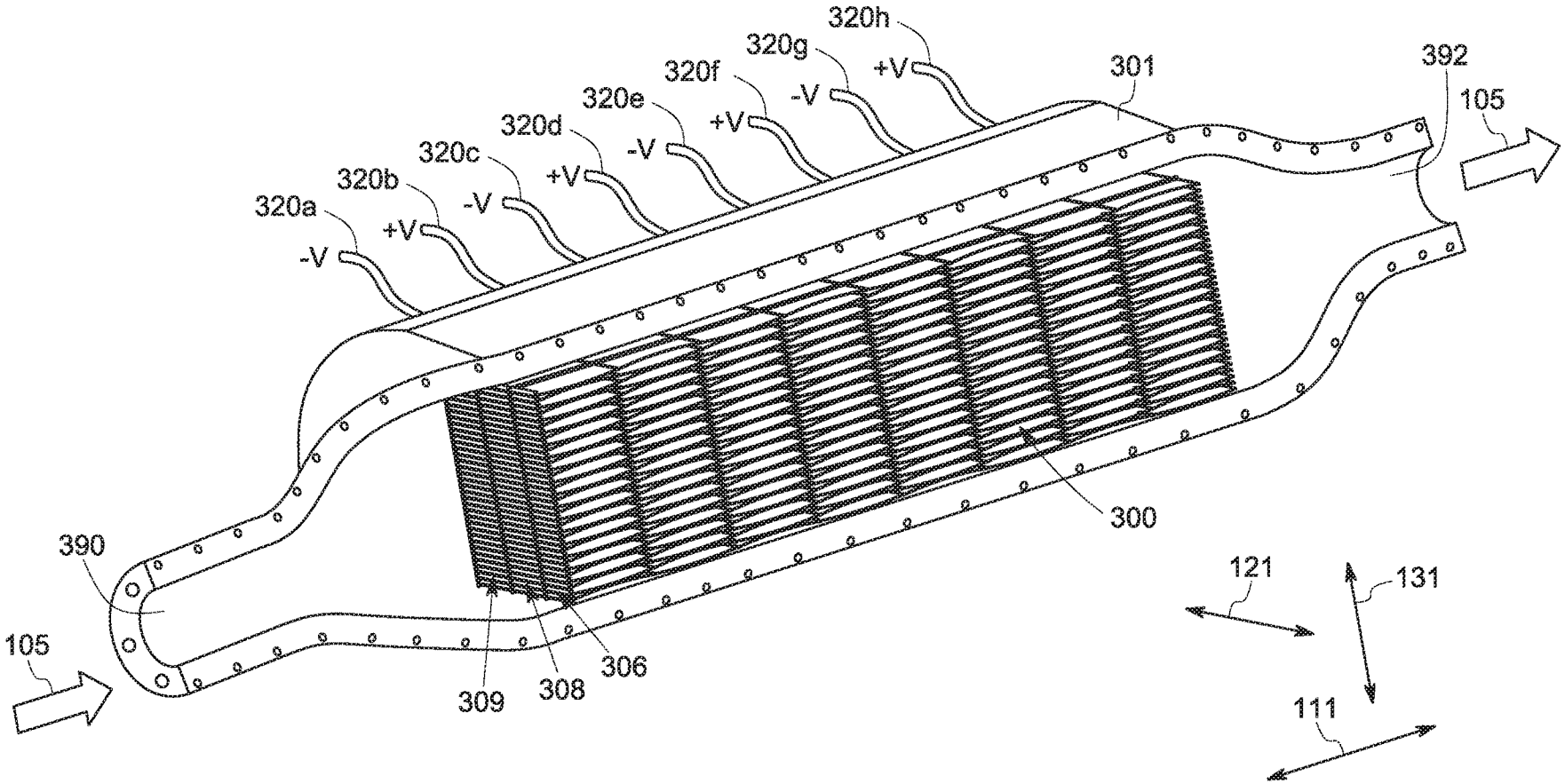
FIG. 7 is a sectional perspective view of a synthetic jet pump disposed in a casing, in accordance with one embodiment.

FIG. 7 is a sectional perspective view of a synthetic jet pump 300 disposed within a casing 301, according to one embodiment of the description. In the illustrated embodiment, the synthetic jet pump 300 includes a plurality of first stacks 306, a plurality of second stacks 308, and a plurality of third stacks 309, which are arranged in an array. For example, array has of 3×8 arrangement of the plurality of first stacks 306, the plurality of second stacks 308, and the plurality of third stacks 309. It should be noted herein that the synthetic jet pump 300 illustrated in the embodiment of FIG. 7 does not show a plurality of first valves, a plurality of second valves, and the plurality of third valves for ease of illustration only.

In the illustrated embodiment, each of the plurality of first stacks 306, the plurality of second stacks 308, and the plurality of third stacks 309 includes eight stacks, which are arranged serially relative to each other along a longitudinal direction 111 of the synthetic jet pump 300. Further, the plurality of second stacks 308 is disposed adjacent to the plurality of first stacks 306 in a parallel arrangement relative to the plurality of first stacks 306 along a lateral direction 121 of the synthetic jet pump 300. Similarly, the plurality of third stacks 309 is disposed adjacent to the plurality of second stacks 308 in the parallel arrangement relative to the plurality of second stacks 308 along the lateral direction 121. Each stack of the plurality of first, second, and third stacks 306, 308, 309 includes a plurality of bimorph pairs disposed in a parallel arrangement relative to each other along a radial direction 131 of the synthetic jet pump 300. In the illustrated embodiment, each stack of the plurality of first, second, and third stacks 306, 308, 309 may include about twenty-four number of bimorph pairs. In the illustrated embodiment, the synthetic jet pump 300 further includes eight power supply lines 320*a*-320*h*, which may be configured to supply electric power to the plurality of first, second, and third stacks 306, 308, 309.

In some embodiments, the casing 301 is a multiphase hydrocarbon fluid line, which is configured to transfer multiphase fluid i.e., the fluid 105 from a hydrocarbon reservoir to a distant fluid storage facility. In such embodiments, the fluid 105 may be electrically non-conductive fluid. In some other embodiments, the casing 301 may be an exhaust transfer pipe line, which may be configured to transfer exhaust from a source, for example, a gas turbine engine to an exhaust treatment system and the like.

In some embodiments, the synthetic jet pump 300 is substantially similar to the synthetic jet pump 200 discussed in the embodiments of FIGS. 1-4. Specifically, the synthetic jet pump 300 is configured such that the plurality of first stacks 306, the plurality of second stacks 308, and the plurality of third stacks 309 are configured to pump fluid 105 simultaneously. In some other embodiments, the synthetic jet pump 300 is substantially similar to the synthetic jet pump 300 discussed in the embodiment of FIG. 5. Specifically, the synthetic jet pump 300 may be configured such that the plurality of first stacks 306, the plurality of second stacks 308, and the plurality of third stacks 309 are configured to pump the fluid 105 sequentially.

During operation, the synthetic jet pump 300 is disposed within the casing 301 is configured to receive the fluid 105 from an inlet 390 of the casing 301 and pump the fluid 105 through the plurality of first stacks 306, the plurality of second stacks 308, and the plurality of third stacks 309, and discharge the fluid 105 to an outlet 392 of the casing 301.

In one embodiment, a method for pumping fluid using a synthetic jet pump is presented. The method includes step (i) of actuating a plurality of first valves to allow intake of a fluid into a plurality of first stacks disposed in a series arrangement relative to each other. A first stack of the plurality of first stacks includes a plurality of first bimorph pairs. The first bimorph pairs are disposed in a parallel arrangement relative to each other. The method further includes step (ii) of actuating a first bimorph pair of a first stack by applying a first voltage signal such that the first bimorph pair expands for receiving the fluid. Further, the method includes step (iii) of actuating a mutually adjacent first bimorph pair of a first stack that is serially arranged with respect to the first stack of the step (ii), by applying a second voltage signal such that the mutually adjacent first bimorph pair contracts for discharging the fluid. The second voltage signal is 180 degrees phase shifted from the first voltage signal.

Figure 8:
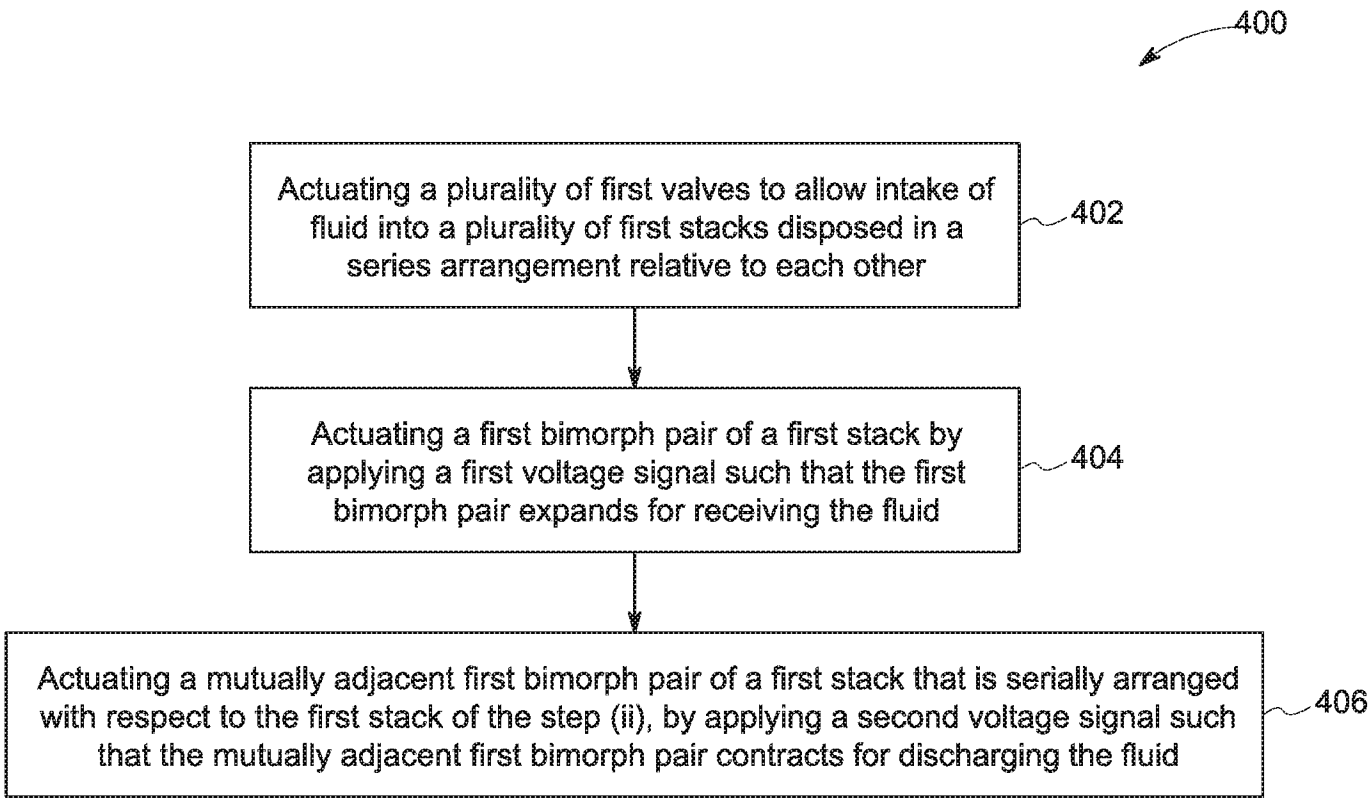
FIG. 8 is a flow chart for a method of pumping fluid using a synthetic jet pump, in accordance with one embodiment.

FIG. 8 illustrates a method 400 for pumping fluid using a synthetic jet pump (as shown in the embodiments of FIGS. 1-7), according to one embodiment of the description.

The method 400 is discussed herein with reference to the embodiment of FIG. 5. The method 400 includes a step (i) of actuating a plurality of first valves 126 to allow intake of fluid 105 into a plurality of first stacks 106 disposed in a series arrangement relative to each other, as shown in stage 402. In such embodiments, a first stack of the plurality of first stacks 106 includes a plurality of first bimorph pairs 113. The first bimorph pairs of the plurality of first bimorph pairs 113 are disposed in a parallel arrangement relative to each other. Further, the method 400 includes a step (ii) of actuating a first bimorph pair 113*a*, 113*b* of a first stack 106*a* by applying a first voltage signal such that the first bimorph pair 113*a*, 113*b* expands for receiving the fluid 105, as shown in stage 404. The method 400 further includes a step (iii) of actuating a mutually adjacent first bimorph pair 113 of a first stack 106*b* that is serially arranged with respect to the first stack 106*a* of the step (ii), by applying a second voltage signal such that the mutually adjacent first bimorph pair 113*c*, 113*d* contracts for discharging the fluid 105, as shown in stage 406. The second voltage signal is 180 degrees phase shifted from the first voltage signal. In some embodiments, the steps (ii) and (iii) are performed simultaneously.

In some embodiments, the method 400 further includes a step (iv) of actuating the first bimorph pair 113*a*, 113*b* of the step (ii) by applying the second voltage signal such that the first bimorph pair 113*a*, 113*b* contracts for discharging the fluid 105. Further, the method 400 includes a step (v) of actuating the mutually adjacent first bimorph pair 113*c*, 113*d* of the step (iii) by applying the first voltage signal such that the mutually adjacent first bimorph pair 113*c*, 113*d* expands for receiving the fluid 105. In such embodiments, the steps (iv) and (v) are performed simultaneously after performing the steps (ii) and (iii).

In one or more embodiments, actuating the first bimorph pair 113*a*, 113*b* of the step (ii) includes applying the first voltage signal to mutually opposite surfaces of the first bimorph pair 113*a*, 113*b*. Further, actuating the mutually adjacent first bimorph pair 113*c*, 113*d* of the step (iii) includes applying the second voltage signal to mutually adjacent surfaces of the mutually adjacent first bimorph pair 113*c*, 113*d*.

In some other embodiments, the method 400 further includes a step (iv) of actuating a plurality of second valves 128 to allow intake of the fluid 105 into a plurality of second stacks 108 disposed in a series arrangement relative to each other. In such embodiments, a second stack of the plurality of second stacks 108 includes a plurality of second bimorph pairs 123. The second bimorph pairs of the plurality of second bimorph pairs 123 are disposed in a parallel arrangement relative to each other. Further, the method 400 includes a step (v) of actuating a second bimorph pair 123*a*, 123*b* of a second stack 108*a* by applying the first voltage signal such that the second bimorph pair 123*a*, 123*b* expands for receiving the fluid 105. The method 400 further includes a step (vi) of actuating a mutually adjacent second bimorph pair 123*c*, 123*d* (as shown in FIG. 4) of a second stack 108*b* that is serially arranged with respect to the second stack 108*a* of the step (v), by applying the second voltage signal such that the mutually adjacent second bimorph pair 123*c*, 123*d* contracts for discharging the fluid 105.

In some embodiments, the plurality of first stacks 106 and the plurality of second stacks 108 are configured to pump the fluid 105 simultaneously, as discussed in the embodiments of FIGS. 1-4. In such embodiments, the steps (ii), (iii) as discussed with respect to the plurality of first stacks 106 and steps (v), (vi) as discussed with respect to plurality of second stacks 108 are performed simultaneously. In some other embodiments, the plurality of first stacks 106 and the plurality of second stacks 108 are configured to pump the fluid 105 sequentially as discussed in the embodiment of FIG. 5. In such embodiments, the steps (ii), (iii) as discussed with respect to the plurality of first stacks 106 and steps (v), (vi) as discussed with respect to the plurality of second stacks 108, are performed sequentially.

The synthetic jet pump of the present disclosure may be arranged in an array to fit in a wide variety of applications such as exhaust transfer pipe line or multiphase hydrocarbon fluid flow line, and the like. In certain embodiments, the synthetic jet pump may be scalable in desired output inline flow rate by increasing size of each bimorph pair and number of bimorph pairs in each stack of one or both of plurality of first and second stacks. Further, the synthetic jet pump may be scalable to increase total flow volume by adding number of parallel sequences of the plurality of stacks. Further, the synthetic jet pump may be easy to fit in any existing space or area due to its flexibility of layout, thereby allowing use in many retrofit applications. Further, the lack of pistons or bearings or motors may provide for reliability and longer shelf life of the synthetic jet pump.

While only certain features of embodiments have been illustrated and described herein, many modifications and changes will occur to those skilled in the art. It is, therefore, to be understood that the appended claims are intended to cover all such modifications and changes as falling within the spirit of the invention.

The invention claimed is:

1. A synthetic jet pump comprising:

a plurality of first stacks disposed in a series arrangement relative to each other, wherein a first stack of the plurality of first stacks comprises:

a plurality of first connector pairs coupled to a first support structure, wherein the first connector pairs are disposed in a parallel arrangement relative to each other; and a plurality of first bimorph pairs, wherein the first bimorph pairs are disposed in a parallel arrangement relative to each other, and wherein a bimorph of one of the first bimorph pairs is coupled to a corresponding connector of the plurality of first connector pairs;

a plurality of first valves disposed at an upstream end of the plurality of first stacks, wherein a valve of the plurality of first valves is movably coupled to the corresponding connector of the plurality of the first connector pairs;

a plurality of second stacks disposed in a series arrangement relative to each other and disposed adjacent to the plurality of first stacks in a parallel arrangement relative to the plurality of first stacks, wherein a second stack of the plurality of second stacks comprises:

a plurality of second connector pairs coupled to a second support structure, wherein the second connector pairs are disposed in a parallel arrangement relative to each other; and a plurality of second bimorph pairs, wherein the second bimorph pairs are disposed in a parallel arrangement relative to each other, and wherein a bimorph of one of the second bimorph pairs is coupled to a corresponding connector of the plurality of second connector pairs.

2. The synthetic jet pump of claim 1, wherein each bimorph of the plurality of first bimorph pairs comprises a piezoelectric material.

3. The synthetic jet pump of claim 2, wherein mutually opposite surfaces of a first bimorph pair of the plurality of first bimorph pairs have different polarities, where a first surface has a first polarity and a second surface opposite the first surface of the first bimorph pair of the plurality of first bimorph pairs has a second polarity different from the first polarity.

4. The synthetic jet pump of claim 1, wherein the plurality of first stacks are coupled to each other via a connector of the plurality of first connector pairs such that a downstream end of a bimorph in a first stack is in fluid communication with an upstream end of a bimorph of an adjacent and serially arranged first stack.

5. The synthetic jet pump of claim 1, further comprising a plurality of second valves disposed at an upstream end of the plurality of second stacks, wherein a valve of the plurality of second valves is movably coupled to the corresponding connector of the plurality of the second connector pairs.

6. The synthetic jet pump of claim 5, wherein each bimorph of the plurality of second bimorph pairs comprises a piezoelectric material.

7. The synthetic jet pump of claim 6, wherein mutually opposite surfaces of a second bimorph pair of the plurality of second bimorph pairs have different polarities, where a first surface has a first polarity and a second surface opposite the first surface of the second bimorph pair of the plurality of second bimorph pairs has a second polarity different from the first polarity.

8. The synthetic jet pump of claim 7, wherein the plurality of first stacks and the plurality of second stacks are arranged in an array.

9. A method for pumping fluid using a synthetic jet pump, comprising steps of:

(i) actuating a plurality of first valves to allow intake of a fluid into a plurality of first stacks disposed in a series arrangement relative to each other, wherein a first stack of the plurality of first stacks comprises a plurality of first bimorph pairs, wherein the first bimorph pairs are disposed in a parallel arrangement relative to each other;

(ii) actuating a first bimorph pair of the first stack in the plurality of first stacks by applying a first voltage signal such that the first bimorph pair expands for receiving the fluid; and (iii) actuating a mutually adjacent first bimorph pair of a first stack that is serially arranged with respect to the first stack of the step (ii), by applying a second voltage signal such that the mutually adjacent first bimorph pair contracts for discharging the fluid, wherein the second voltage signal is 180 degrees phase shifted from the first voltage signal.

10. The method of claim 9, wherein the steps (ii) and (iii) are performed simultaneously.

11. The method of claim 9, further comprising a step of (iv) actuating the first bimorph pair of the step (ii) by applying the second voltage signal such that the first bimorph pair contracts for discharging the fluid.

12. The method of claim 11, further comprising a step of (v) actuating the mutually adjacent first bimorph pair of the step (iii) by applying the first voltage signal such that the mutually adjacent first bimorph pair expands for receiving the fluid.

13. The method of claim 12, wherein the steps (iv) and (v) are performed simultaneously after performing the steps (ii) and (iii).

14. The method of claim 9, wherein actuating the first bimorph pair of the step (ii) comprises applying the first voltage signal to mutually opposite surfaces of the first bimorph pair.

15. The method of claim 9, wherein actuating the mutually adjacent first bimorph pair of the step (iii) comprises applying the second voltage signal to mutually adjacent surfaces of the mutually adjacent first bimorph pair.

16. The method of claim 9, further comprising steps of:

(iv) actuating a plurality of second valves to allow intake of the fluid into a plurality of second stacks disposed in a series arrangement relative to each other, wherein a second stack of the plurality of second stacks comprises a plurality of second bimorph pairs, wherein the second bimorph pairs are disposed in a parallel arrangement relative to each other;

(v) actuating a second bimorph pair of a second stack by applying the first voltage signal such that the second bimorph pair expands for receiving the fluid; and (vi) actuating a mutually adjacent second bimorph pair of a second stack that is serially arranged with respect to the second stack of the step (v), by applying the second voltage signal such that the mutually adjacent second bimorph pair contracts for discharging the fluid.

17. The method of claim 16, wherein the plurality of first stacks and the plurality of second stacks are configured to pump the fluid simultaneously.

18. The method of claim 16, wherein the plurality of first stacks and the plurality of second stacks are configured to pump the fluid sequentially.

* * * * *